United States Patent [19]

Baggio et al.

[11] Patent Number: 4,799,297

[45] Date of Patent: Jan. 24, 1989

[54] CLOSURE AND SECURING DEVICE, PARTICULARLY FOR SKI BOOTS

[75] Inventors: Giorgio Baggio, San Martino di Lupari; Giuseppe De Bortoli, Montebelluna, both of Italy

[73] Assignee: Nordica S.P.A., Montebelluna, Italy

[21] Appl. No.: 102,182

[22] Filed: Sep. 28, 1987

[30] Foreign Application Priority Data

Oct. 9, 1986 [IT] Italy ..... 59450/86[U]

[51] Int. Cl.[4] ..... A43C 11/00

[52] U.S. Cl. ..... 24/68 SK; 36/50

[58] Field of Search ..... 24/68 SK, 68 B, 70 SK, 24/71 SK, 71.2; 36/50, 117

[56] References Cited

U.S. PATENT DOCUMENTS 3,729,779 5/1973 Porth ..... 24/68 SK
4,433,456 2/1984 Baggio ..... 24/68 SK
4,616,524 10/1986 Bidoia ..... 36/50
4,660,302 4/1987 Arieh et al. ..... 36/50
4,719,710 1/1988 Pozzobon ..... 24/68 SK

*Primary Examiner*—Victor N. Sakran
*Attorney, Agent, or Firm*—Guido Modiano; Albert Josif

[57] ABSTRACT

Closure and securing device, particularly for ski boots, composed of a lever associated with a ski boot and having at least one winding assembly comprising: a pulley rotatably associated with the lever and rigidly associated in rotation with a knob which can be operated from outside, a first gear rigidly associated in rotation with the pulley and a second gear rigidly associated with the lever. Releasable engagement means being provided for mutually engaging the first and second gears to prevent the rotation of the pulley with respect to the lever and uncoupling means to uncouple the first gear from the second one to allow the rotation of the pulley.

10 Claims, 3 Drawing Sheets

CLOSURE AND SECURING DEVICE, PARTICULARLY FOR SKI BOOTS

BACKGROUND OF THE INVENTION

The present invention relates to a closure and securing device, particularly usable for ski boots.

Various devices are currently known which are applied to ski boots and allow to achieve, for example, the closure of the quarters and/or the actuation of one or more pressers arranged inside the boots.

Some of these devices essentially consist of a knob rotatably associated with the boot and provided with a winding pulley for a cable.

The disadvantage of these known types resides in the fact that the skier is forced to impart a considerable number of turns to the knob to achieve, for example, the optimum fastening of the quarters.

SUMMARY OF THE INVENTION

The aim of the present invention is therefore to eliminate the disadvantages described above in known types by providing a device which allows the rapid winding of a cable or the like, allowing the skier to also perform a fine adjustment of the fastening.

Within the scope of the above described aim, another important object is to obtain a device which has a very compact structure with modest weight and dimensions which facilitate its positioning and use in a ski boot.

Another important object is to provide a device which allows, besides a rapid winding, also a similarly rapid unwinding of the cable or the like.

Not least object is to provide a device which is remarkably reliable by virtue of the limited number of components, said device at the same time being able to accommodate other devices useful for the skier.

The aim and the objects described above, as well as others which will become apparent hereinafter, are achieved by a closure and securing device, particularly for ski boots, comprising a lever , associated with a ski boot, and characterized in that said lever comprises at least one winding assembly adapted to wind one or more traction elements, said winding assembly comprising: a pulley rotatably associated with said lever and rigidly associated in rotation with a knob which can be accessed from outside, a first gear rigidly associated in rotation with said pulley and a second gear rigidly associated with said lever releasable engagement means being provided for mutually engaging said first gear and said second gear to prevent said rotation of said pulley with respect to said lever and uncoupling means to uncouple said first gear and said second gear to allow said rotation of said pulley.

BRIEF DESCRIPTION OF THE DRAWINGS

Further characteristics and advantages of the invention will become apparent from the detailed description of a preferred, but not exclusive, embodiment, illustrated only by way of non-limitative example in the accompanying drawings, wherein.

DESCRIPTION OF THE PREFERRED EMBODIMENTS

Figure 1:
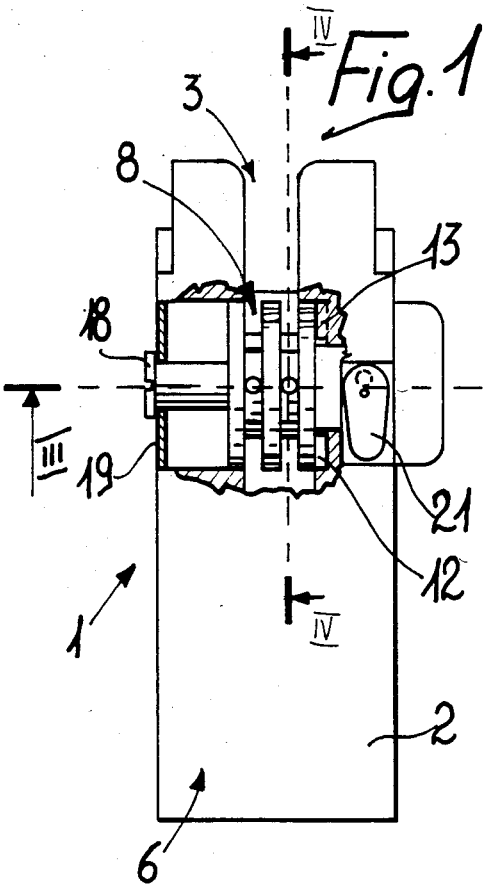
FIG. 1 is a front view, in partial cross section, of the device.
Figure 2:
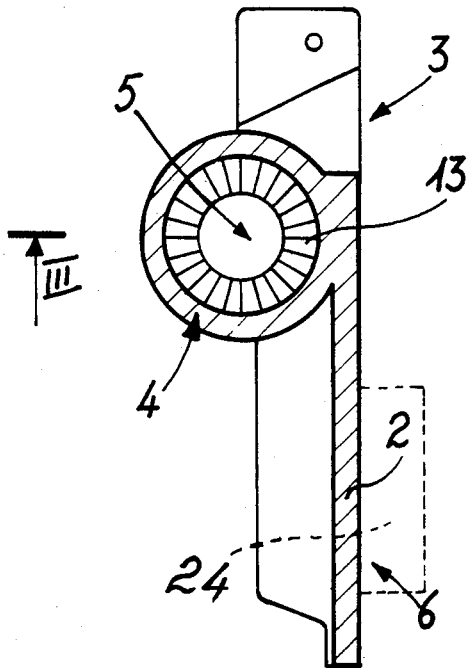
FIG. 2 is a lateral view of the lever, in cross section along a longitudinal axis.
Figure 3:
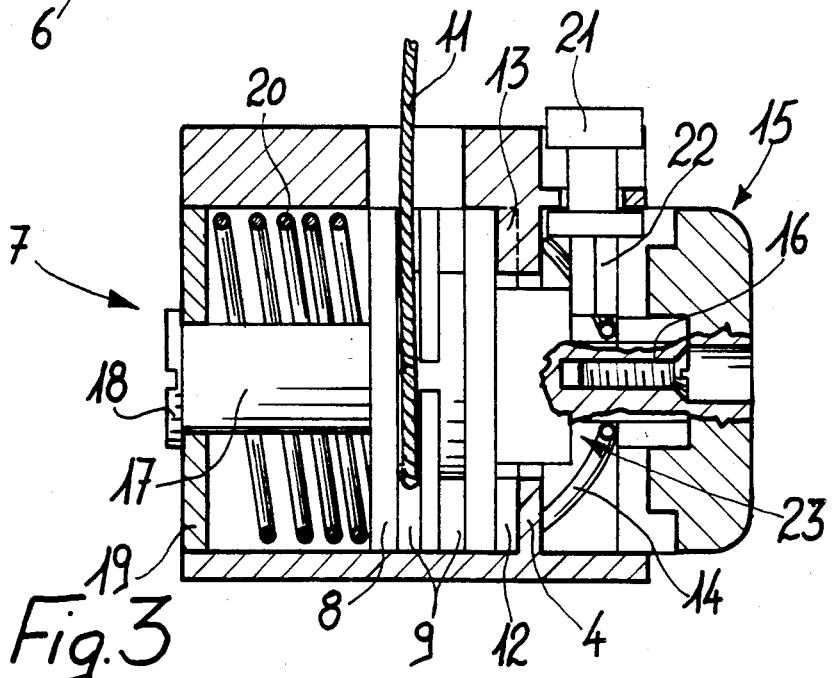
FIG. 3 is a section view along the line III—III of FIG. 1.

With reference to the above described figures, the device 1 comprises a lever 2 which can be pivoted at its upper end to adapted elements protruding from the shell and/or from the quarter of a ski boot.

Said lever 2 is provided, at the upper end, with a longitudinal milling and transversely with a hollow cylindrical body which defines on one side a lateral shoulder 4 provided with an axial hole 5.

The lower end 6 of the lever 2 is instead provided with a planar configuration, with which are associable various devices or electronic instruments (schematically indicated by the reference numeral 24) useful to the skier, such as thermometers, timepieces, chronographs, hygrometers powered by accumulators (not illustrated for the sake of simplicity) associable with said lever 2 or with the ski boot.

A winding assembly 7 is rotatably associable with the hole 5 of the hollow body and, for example, consists of a pulley 8 which, in the preferred embodiment, is provided with a pair of grooves 9.

A through hole 10 is provided diametrally with respect to each of said grooves and acts as a seat for a cable 11.

The number of grooves can be variable according to the number of functions which can be performed in a ski boot.

The diameters of the grooves can also be variable to obtain different degrees of winding of said cable depending on the specific function performed.

A first gear 12 is provided at the end of the pulley which faces said shoulder 4 and engages a second gear 13 provided at the shoulder 4.

The coupling between said first gear 12 and said second gear 13 is ensured by a spring 14 interposed between the surface of the shoulder 4 opposite to the one provided with the gear 13 and with a knob 15 axially connected to a small shaft 16; the latter is rigidly associated with the pulley 8 and protrudes axially from the hole 5.

The pulley 8 is provided, on the opposite side with respect to the gear 12, with a cylindrical axial body 17 which protrudes at the hole 5, a closure washer 19 being associated therewith by virtue of known means such as a screw 18.

A means for the rapid rewinding of the pulley 8 is interposed coaxially with respect to the body 17, and consists of a spring 20 the ends whereof are associated with the lever 2 and with the pulley 8.

A small lever 21 is furthermore pivoted to the lever 2 perpendicular to the axis of the pulley and at the small shaft 16, and comprises an eccentric 22 interacting in abutment with a step-like discontinuity 23 provided on said shaft 16.

Figures 4, 5, 6, 7:
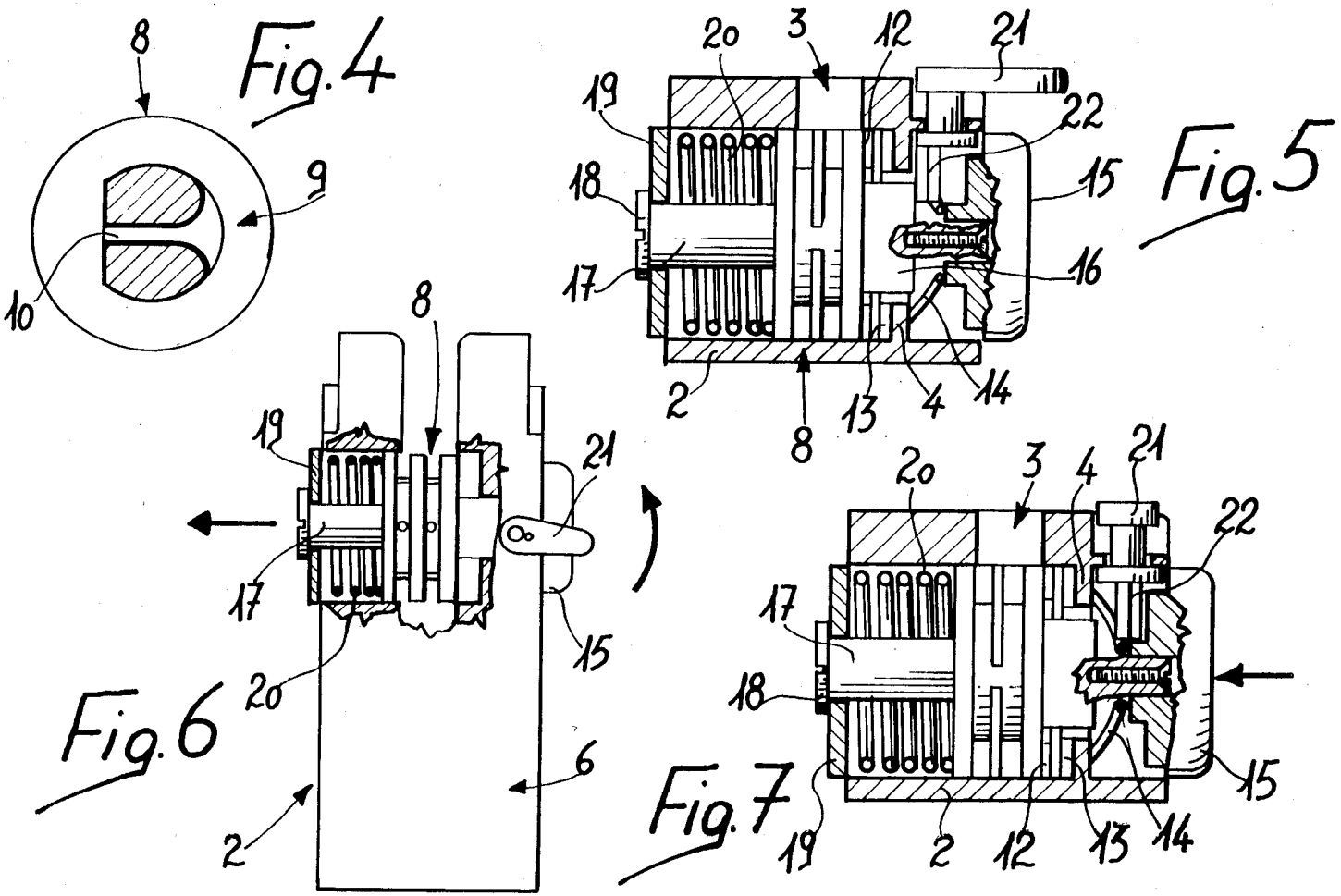
FIG. 4 is a section view along the line IV—IV of FIG. 1 of the winding assembly alone.
FIGS. 5 and 6 are views, respectively similar to those of FIGS. 3 and 1, of the device in the unwinding position.
FIG. 7 is a view, similar to that of FIG. 3, of the device in the unwinding position achieved by a pressure operated on the knob.

A rotation imparted to the small lever 21 in the direction illustrated in FIG. 6 causes the eccentric 22 to axially push the small shaft 16 in the opposite direction with respect to that of the knob 15, said axial movement allowing the uncoupling of the first gear 12 from the second gear 13.

This axial movement allows therefore to arrange the pulley in a free condition, accordingly allowing the unwinding of the cables 11 of the pulley 8 and, simultaneously, the loading of the spring 20.

Supposing the cable 11 allows the fastening of the quarters, once the skier has put the boot on he can manually move said quarters closer, the cable being winded rapidly at one of the grooves 9 by the action of the spring 20.

Subsequently the skier returns the small lever 21 to the condition illustrated in FIG. 1, this allowing, by the action of the spring 14, the first gear 12 and the second gear 13 to engage again with one another.

In this condition the pulley can no longer rotate in the direction of unwinding, but by virtue of the presence of the knob 15, it can be rotated in the direction of winding of the cable 11, with the consequent final adjustment of the degree of locking, as described hereinafter.

The fact is furthermore stressed that the knob 15 is shaped, at the surface facing the small lever 21, so that it is possible to impart thereto an axial movement, as indicated in FIG. 7, such as to again allow the mutual uncoupling of the gears 12 and 13 without acting on said small lever 21.

In fact, in order to wind the cable 11 on the pulley 8 it is sufficient to press on the knob 15 to disengage the first gear 12 from the second gear 13.

This operation is preferably performed for a fine adjustment of the degree of fastening, for example of the quarters of the boot, while for the normal opening and closure operations it is possible to act only on the lever 2 in a conventional manner.

Figure 9:
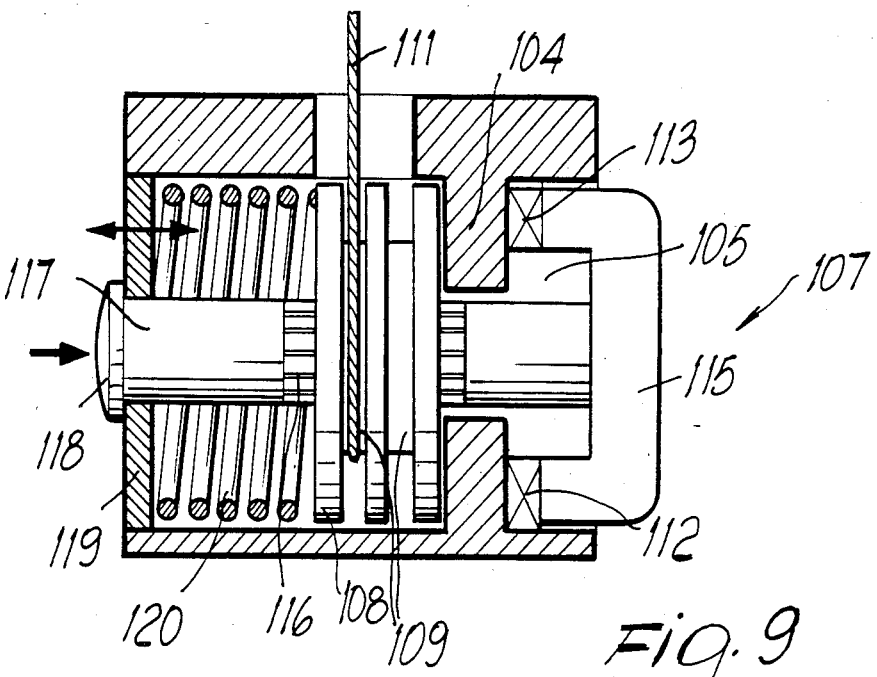
FIG. 9 is a cross section view along the line XIII XIII of FIG. 8.
Figure 8:
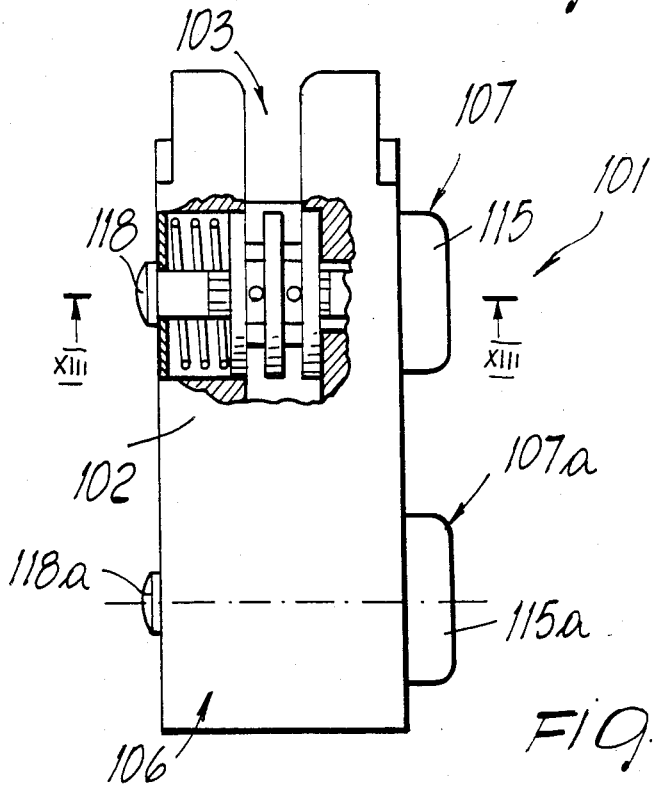
FIG. 8 is a front elevation view, in partial cross section, of the device according to another aspect of the invention.

FIGS. 8 and 9 illustrate a device 101 according to another aspect of the invention and substantially similar to the device 1 described above except for the following details of the winding assembly 107.

The knob 115 is rigidly associated with a shaft 117 accommodated in the axial hole 105 provided in the lateral shoulder 104 of the lever 102. The inner edge of the knob 115 is provided with a first gear 112 adapted to engage with a second gear 113 provided on the lateral shoulder 104 so as to lock the rotation of the shaft 117 with respect to the lever 102. The shaft 117 is provided with a central grooved portion 116 for its engagement with the pulley 108 so that the shaft 117 can slide axially with respect to the pulley 108 but is rigidly associated thereto in rotation.

The shaft 117 is provided, at the opposite end with respect to the one engaged with the knob 115, with a pushbutton 118 abutting with a cover 119; a spring 120 is interposed between the cover 119 and the pulley 108 and exerts such a force as to keep the gears 112 and 113 engaged.

In order to disengage the gears and thus allow the unwinding of the cable 111 on the pulley 108, or its winding, it is sufficient to press the pushbutton 118, in the direction of the arrow as illustrated in FIG. 9, causing the shaft 117 and thus the knob 115 to shift towards the right.

The spring 120 can also be simply interposed between the cover 119 and the pulley 108 to engage the gears 112 and 113 as described without having the function of allowing a rapid winding of the cable 111 on the pulley 108 as previously described.

The device can also be provided with more than one winding assembly associated with the lever; FIG. 8 illustrates, by way of example, the lever 102 provided with two winding assemblies 107 and **107*a*, the latter being associated with the lower end 106 of the lever 102**.

It has thus been observed that the invention achieves the intended aim and objects, a device having been provided which allows the rapid rewinding of a cable or the like, allowing the skier to also perform a fine adjustment of the fastening thereof.

The very compact structure of the device and its modest weight allow its easy placement in any point of the boot, this compactness furthermore allowing the placement of small devices or electronic instruments at the end 6 of the lever 2.

The device furthermore allows the automatic recovery of the cables, and is furthermore very simple in use and remarkably reliable also due to the limited number of components which constitute it.

Naturally, the materials which constitute said components, as well as their dimensions, may be any according to the specific requirements.

We claim:

1. Closure and securing device, particularly for ski boots, comprising a lever having an end, said lever being associable with a ski boot and having at least one winding assembly, said winding assembly being adapted for winding at least one ski boot traction element and comprising an externally accessable knob, a pulley rotatably associated with said lever and being rigidly rotatively associated with said knob, a first gear rigidly rotatively associated with said pulley, a second gear rigidly associated with said lever, releasable engagement means adapted for mutually engaging said first gear and said second gear to prevent rotation of said pulley with respect to said lever, uncoupling means adapted for uncoupling said first gear and said second gear to allow said rotation of said pulley, a cylindrical hollow body arranged transversely with respect to said lever, proximate to said end thereof, said cylindrical hollow body being pivotally associable with a ski boot and defining a lateral shoulder, said lateral shoulder having an axial hole, said winding assembly being rotatably associated with said hollow body.

2. Device according to claim 1, wherein said pulley has an end, a shaft, and a cylindrical body, said shaft protruding through said axial hole of said lateral shoulder.

3. Device according to claim 2, wherein said knob is associated with said small shaft an wherein a closing washer is associated with said cylindrical body.

4. Device according to claim 3, further comprising rapid rewinding means, said pulley having an end and a cylindrical body, said cylindrical body being located at said end of said pulley, said rapid rewinding means being adapted for causing rapid rewinding of said pulley and comprising a spring having at least one end and at least one other end, said spring being interposed between said end of said pulley and said closing washer, said at least one end of said spring being associated with said lever, said at least one other end of said spring being associated with said pulley.

5. Device according to claim 1, wherein said shaft is located at said end of said pulley and faces said lateral shoulder when said first gear engages with said second gear, said device further comprising a spring, said knob having a knob surface, said lateral shoulder having a lateral shoulder surface, said spring being interposed between said knob surface and said lateral shoulder surface for coupling said first gear and said second gear.

6. Device according to claim 5, further comprising a small lever, said pulley having an axis and a shaft, said small lever being pivoted to said lever perpendicularly to said axis of said pulley at said small shaft, said small lever being externally accessable and comprising an eccentric, said eccentric being adapted for interacting in abutment engagement relationship with a step-like discontinuity, said step-like discontinuity being formed on said small shaft.

7. Device according to claim 5, further comprising a small lever, said pulley having an axis and a shaft, said small lever being pivoted to said lever perpendicularly to said axis of said pulley at said small shaft, said small lever being externally accessable and comprising an eccentric, said knob being associated with said small shaft and being axially movable for causing said first gear and said second gear to mutually uncouple without said knob interacting with said eccentric of said small lever 8. Device according to claim 5, further comprising a small lever, said pulley having an axis and a shaft, said small lever being pivoted to said lever perpendicularly to said axis of said pulley at said small shaft, said small lever being externally accessable and comprising an eccentric, said winding assembly being axially movable with respect to said cylindrical body, said small lever being rotatable for causing said eccentric to axially move said winding assembly for uncoupling said first gear and said second gear.

9. Device according to claim 1, wherein said shaft has a second end, said second end having a pushbutton, said pushbutton abutting with a cover, said cover being slideable within said hollow body, said device further comprising an elastic element, said elastic element being interposed between said pulley and said cover.

10. Device according to claim 9, wherein said knob has a side facing said lateral shoulder, and wherein said lateral shoulder has a side facing said knob, said first gear being located at said side of said knob facing said lateral shoulder, said second gear being located at said side of said lateral shoulder facing said knob.

* * * * *